US006104141A

United States Patent [19]

Ganser et al.

[11] Patent Number: 6,104,141

[45] Date of Patent: Aug. 15, 2000

[54] INVENTER-BALLAST USING A PIEZOELECTRIC TRANSFORMER

[75] Inventors: Hans G. Ganser; Dieter Leers, both of Stolberg; Klaus Löhn, Simmerath-Lammersdorf; Martin Ossmann, Aachen, all of Germany; Pieter Postma, Eindhover, Netherlands

[73] Assignee: U.S. Philips Corporation, New York, N.Y.

[21] Appl. No.: 09/140,813

[22] Filed: Aug. 26, 1998

[30] Foreign Application Priority Data

Sep. 1, 1997 [EP] European Pat. Off. ..... 97202685

[51] Int. Cl.[7] ..... H05B 37/02

[52] U.S. Cl. ..... 315/209 PZ; 315/219; 315/224

[58] Field of Search ..... 315/209 PZ, 209 R, 315/224, 219, 307, 291, 308, DIG. 5

[56] References Cited

U.S. PATENT DOCUMENTS

| | | | |
|---|---|---|---|
| 5,670,849 | 9/1997 | Melai | 315/224 |
| 5,677,602 | 10/1997 | Paul et al. | 315/307 |
| 5,705,897 | 1/1998 | Hanazaki et al. | 315/307 |
| 5,786,671 | 7/1998 | Lee | 315/224 |
| 5,796,213 | 8/1998 | Kawasaki | 315/209 PZ |
| 5,834,907 | 11/1998 | Takehara | 315/224 |

FOREIGN PATENT DOCUMENTS

| | | |
|---|---|---|
| 689789 | 3/1994 | Japan . |

*Primary Examiner*—Haissa Philogene
*Assistant Examiner*—Wilson Lee
*Attorney, Agent, or Firm*—Bernard Franzblau

[57] ABSTRACT

A circuit arrangement for operating a lamp has circuit input terminals for connection to a supply voltage source. An inverter is coupled to the circuit input terminals for generating an AC voltage with a frequency f from a supply voltage supplied by the supply voltage source and includes inverter output terminals. A piezotransformer has input terminals coupled to the inverter output terminals. Terminals for lamp connection are coupled to the inverter output terminals. A detector detects whether the lamp has ignited. The transformer input terminals are connected to the inverter output terminals only by means of passive components and the inverter comprises means coupled to the detector for changing the frequency f in response to the ignition of the lamp. The circuit arrangement is simple and inexpensive and need not provide a device for switching the piezotransformer out of the circuit after ignition of the lamp.

20 Claims, 2 Drawing Sheets

INVENTER-BALLAST USING A PIEZOELECTRIC TRANSFORMER

BACKGROUND OF THE INVENTION

This invention relates to a circuit arrangement for operating a lamp comprising circuit input terminals for connection to a supply voltage source, an inverter coupled to said circuit input terminals for generating an AC voltage at a frequency f from a supply voltage supplied by the supply voltage source, and equipped with inverter output terminals, a piezotransformer comprising transformer input terminals, coupled to the inverter output terminals, and transformer output terminals, terminals for lamp connection coupled to the inverter output terminals, and a detector for detecting whether the lamp has ignited.

Such a circuit arrangement is known from Jp H6-89789. The known circuit arrangement is very suitable for operating a discharge lamp and comprises a switching circuit part that connects the inverter output to the transformer input during the ignition of the lamp. The lamp is directly connected to the transformer output terminals. The frequency f of the AC voltage generated by the inverter is very close to one of the resonance frequencies of the piezotransformer. Therefore, the AC voltage is transformed by the piezotransformer to an ignition voltage at the same frequency f but at a much higher amplitude that is present across the lamp. After the lamp has ignited under the influence of this ignition voltage, the detector, which is a part of the circuit arrangement, detects a lamp current and generates a signal that triggers the switching circuit part to disconnect the inverter output and the transformer input. After the transformer input has been disconnected from the inverter output, the piezotransformer no longer generates the ignition voltage and the lamp is operated by means of the AC voltage at the frequency f that is generated by the inverter. An important advantage of the known circuit arrangement is that the inverter is used both in the generation of the voltage that is used to operate the lamp during stationary conditions as well as in the generation of the ignition voltage. For this reason the known circuit arrangement comprises a relatively small amount of components and is therefore relatively inexpensive and compact. A disadvantage of the known circuit arrangement, however, is that although a separate oscillator to drive the piezotransformer during ignition can be dispensed with, the switching circuit part comprised in the known circuit arrangement is relatively expensive and complex.

SUMMARY OF THE INVENTION

The invention aims to provide a circuit arrangement for operating a lamp in which a separate oscillator for driving the piezotransformer can be dispensed with and that is equipped with relatively simple and inexpensive means to change the operation of the circuit arrangement after the lamp has ignited.

A circuit arrangement as described in the opening paragraph is therefore characterized in that the inverter comprises frequency control means coupled to the detector for changing the frequency f in response to the ignition of the lamp.

The frequency f of the AC voltage that is generated during ignition by the inverter included in a circuit arrangement according to the invention is very close to a resonance frequency of the piezotransformer. For this reason the piezotransformer effectively transforms the AC voltage into an ignition voltage with a relatively high amplitude. After ignition the frequency control means for changing the frequency f in response to the ignition of the lamp change the frequency to a value that differs substantially from all the resonance frequencies of the piezotransformer so that the transformation factor (Vout/Vin) of the piezotransformer is very small. As a result the operating voltage that is present across the lamp is substantially determined by the AC voltage generated by the inverter so that the frequency change has effectively switched the piezotransformer off. A change in the frequency f of the AC voltage generated by the inverter can be accomplished making use of relatively simple and inexpensive means. Since it is unnecessary to disconnect the transformer input terminals and the inverter output terminals, the connection between them can be realized using only passive components.

Preferably, the frequency control means change the frequency from a first fixed value to a second fixed value in response to the ignition of the lamp.

Good results have been obtained with a circuit arrangement according to the invention, wherein the transformer output terminals are coupled to the terminals for lamp connection and a filter is coupled between the inverter output the terminals and terminals for lamp connection. In this topology the lamp is ignited by generating an ignition voltage between the terminals for lamp connection. However, since the inverter output terminals are also coupled to the terminals for lamp connection it is often necessary to protect the inverter against the occurrence of a relatively high voltage between the inverter output terminals. This protection can be realized by means of a filter. Alternatively, it is possible to couple a first transformer output terminal to one of the terminals for lamp connection and couple a second transformer output terminal to an auxiliary electrode. During ignition this auxiliary electrode is present outside of the lamp in the direct vicinity of the lamp vessel. The ignition voltage is present between the auxiliary electrode and a first electrode of the lamp connected to the terminal for lamp connection that is coupled to the first transformer output terminal. Since the distance between the first electrode of the lamp and the auxiliary electrode can be adjusted to be much smaller than the distance between the electrodes of the lamp, the use of an auxiliary electrode renders a very effective ignition of the lamp possible. The auxiliary electrode can be a part of the lamp but can also be a part of the circuit arrangement.

The detector may comprise a current sensor that directly or indirectly measures a current through the lamp. In this way the detector is realized in a relatively simple and effective way.

Good results have been obtained for a circuit arrangement according to the invention, wherein the inverter comprises a bridge circuit.

A relatively simple and inexpensive embodiment of a circuit arrangement according to the invention is obtained in the case where the transformer input terminals are connected directly to the inverter output terminals.

BRIEF DESCRIPTION OF THE DRAWINGS

Embodiments of a circuit arrangement according to the invention will be illustrated making use of a drawing.

In the drawing

DESCRIPTION OF THE PREFERRED EMBODIMENTS

Figure 1:
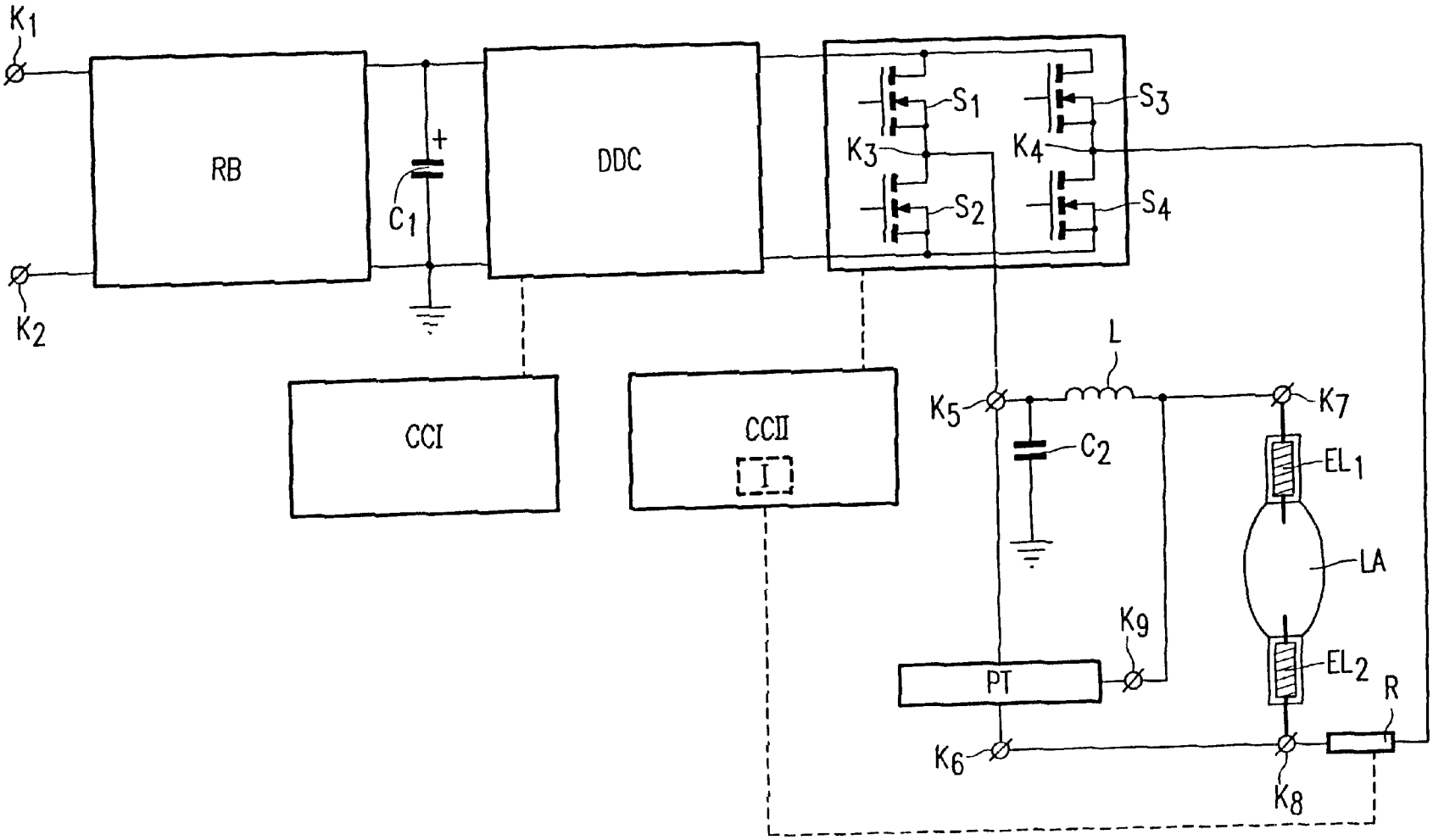
FIG. 1 shows a schematic representation of a first embodiment of a circuit arrangement according to the invention with a lamp connected to it.

In FIG. 1, K1 and K2 are circuit input terminals for connection to a supply voltage source. K1 and K2 are connected to respective input terminals of rectifier bridge RB. Output terminals of rectifier bridge RB are connected by means of a capacitor C1 functioning as a buffer capacitor. One end of capacitor C1 is connected to ground potential. Respective ends of capacitor C1 are connected to input terminals of a DC-DC-converter DDC comprising inductive means, unidirectional means and at least one switching element. A control electrode of the switching element is connected to a first control circuit CC1 for generating a control signal for rendering the switching element conductive and non-conductive at a high frequency. This connection is represented schematically in FIG. 1 by means of a dotted line connecting an output terminal of the first control circuit CC1 with an input terminal of the DC-DC-converter DDC. Output terminals of the DC-DC-converter are connected to respective input terminals of a full bridge circuit that is formed by the series arrangement of switching elements S1 and S2, the series arrangement of switching elements S3 and S4 and the second control circuit CCII for rendering the switching elements S1-S4 conducting and non-conducting with a frequency f. Respective output terminals of second control circuit CCII are connected to the respective control electrodes of the switching elements S1–S4. These connections are shown schematically by means of the dotted line that connects second control circuit CCII to the full bridge circuit. The DC-DC-converter DDC together with the first control circuit CC1 and the full bridge circuit together form an inverter for generating an AC voltage at a frequency f from a supply voltage. The second control circuit CCII comprises a circuit part I. Circuit part I forms a means for changing the frequency f in response to the ignition of the lamp. For this purpose circuit part I is coupled to resistor R. This coupling is indicated by means of a dotted line. K3 and K4 are inverter output terminals. K5 and K6 are input terminals of piezotransformer PT. K7 and K8 are terminals for lamp connection. Output terminal K3 is connected to input terminal KS and output terminal K4 is connected to both input terminal K6 and lamp connection terminal K8 via ohmic resistor R. Input terminal K5 is connected to lamp connection terminal K7 by means of choke L. Input terminal K5 is also connected to ground potential by means of capacitor C2. Choke L and capacitor C2 together form a filter. Ohmic resistor R forms a 30 detector for detecting whether the lamp has ignited. Output terminal K9 of piezotransformer PT is connected to lamp connection terminal K7. In the embodiment shown in FIG. 1, K6 forms another output terminal of piezotransformer PT. A high pressure discharge lamp La comprising electrodes E11 and E12 is connected to the terminals for lamp connection.

The operation of the circuit arrangement shown in FIG. 1 is as follows.

When the circuit input terminals are connected to the poles of a supply voltage source supplying a low frequency AC supply voltage, the low frequency AC supply voltage is rectified by means of the rectifier bridge RB, so that a DC voltage is present across capacitor C1. The first control circuit CCI renders the switching element comprised in the DC-DC-converter DDC conducting and non-conducting at a high frequency. As a result the DC voltage present on capacitor C1 is converted by means of DC-DC-converter DDC into a substantially constant DC voltage present between the input terminals of the full bridge circuit. The second control circuit CCII renders on the one hand switching elements S1 and S4 and on the other hand switching elements S2 and S3 alternately conducting and non-conducting at a frequency f. Out of the substantially constant DC voltage that is present between its input terminals, the full bridge circuit generates a substantially square wave shaped AC voltage at a frequency f that is present between the inverter output terminals K3 and K4. This substantially square wave shaped AC voltage is also present between the transformer input terminals K5 and K6. During lamp ignition the frequency f is chosen so that it is very close to one of the resonance frequencies of the piezotransformer PT. The piezotransformer transforms the substantially square wave shaped AC voltage at the frequency f to a sinusoidal ignition voltage at the frequency f and with a relatively high amplitude that is present between transformer output terminals K6 and K9 and between terminals K7 and K8 for lamp connection. The filter that is formed by choke L and capacitor C2 protects the full bridge circuit against the ignition voltage present across the lamp La. When the lamp ignites under the influence of the ignition voltage, the lamp and also the resistor R start conducting a current. In reaction to the occurrence of a voltage drop across the resistor R, the circuit part I comprised in the second control circuit CCII changes the frequency f at which the switching elements comprised in the full bridge circuit are rendered conducting and non-conducting to a value that corresponds to the stationary operation of the lamp. The frequency f is changed to a value that differs substantially from all the resonance frequencies of the piezotransformer so that at that frequency its voltage transformation ratio is very low and the voltage across the lamp is therefore almost completely determined by the inverter.

Figure 2:
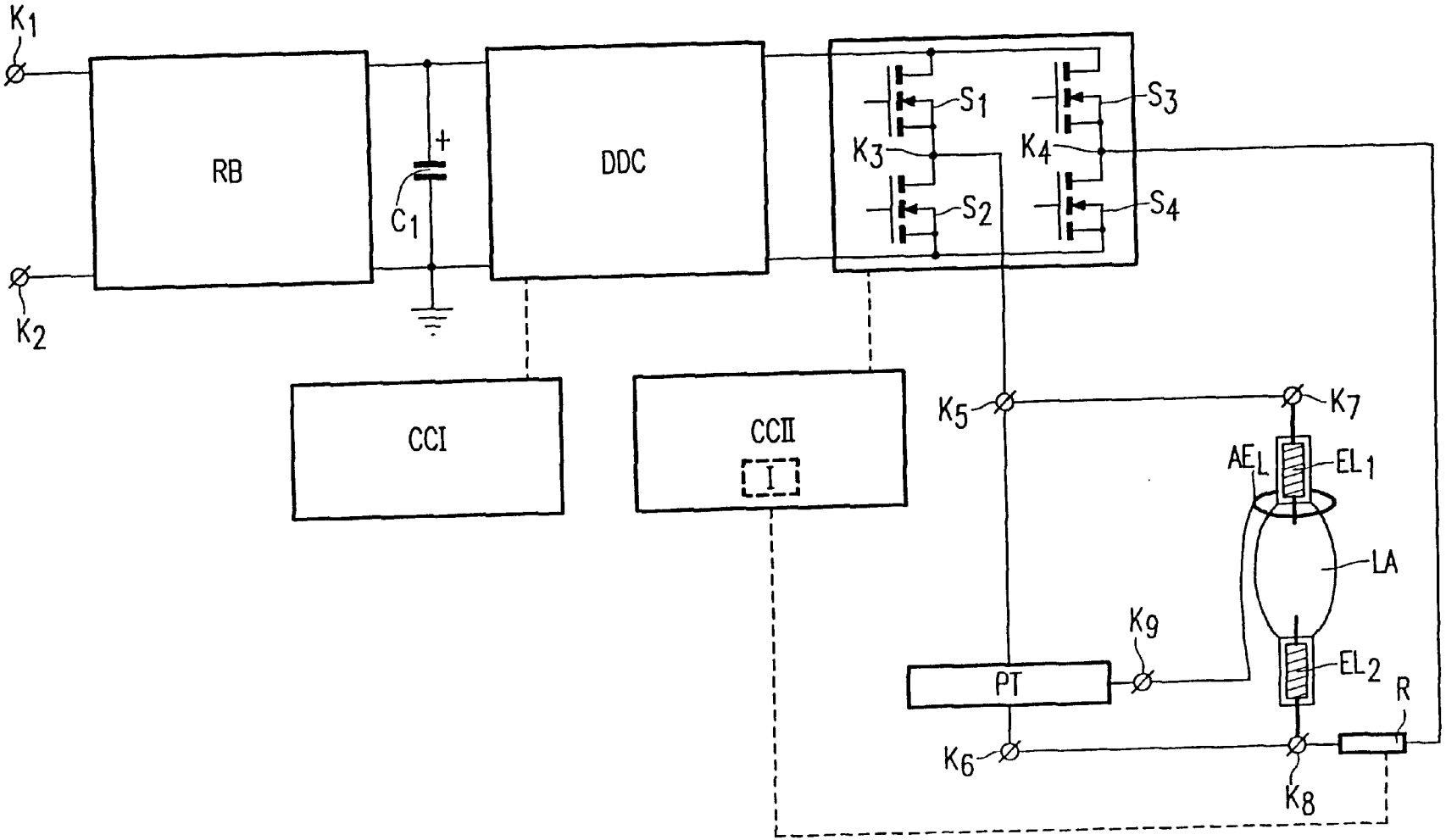
FIG. 2 shows a schematic representation of a second embodiment of a circuit arrangement according to the invention with a lamp connected to it.

The embodiment of a circuit arrangement according to the invention that is shown in FIG. 2 is to a large extent identical to the embodiment shown in FIG. 1. Components and/or circuit parts of the embodiment shown in FIG. 2 that are similar to components and/or circuit parts in the embodiment shown in FIG. 1 are labelled similarly. An important difference between the embodiments shown in FIG. 1 and FIG. 2 is that in the latter the transformer output terminal K9 of piezotransformer PT is connected to an auxiliary electrode AEL instead of to terminal K7 for lamp connection. The auxiliary electrode is a body of electrically conducting material such as for instance Ni that is present outside the lamp vessel in the vicinity of one of the lamp electrodes, in this case E11. In the embodiment shown in FIG. 2, K5 functions both as a transformer input terminal as well as a transformer output terminal. Therefore the ignition voltage is present between lamp electrode E11 and the auxiliary electrode AEL during ignition of the lamp. Because of the use of the auxiliary electrode AEL, the filter that is present in the embodiment shown in FIG. 1 can be dispensed with. Furthermore, since the distance between lamp electrode E11 and auxiliary electrode AEL can be chosen relatively small, the ignition behaviour of the lamp is strongly improved. During ignition of the lamp the ignition voltage establishes a discharge between lamp electrode E11 and auxiliary electrode AEL. This discharge introduces so many charge carriers in the plasma of the lamp that another discharge between lamp electrodes E11 and E12 is established almost immediately after the discharge between lamp electrode E11 and auxiliary electrode AEL.

After the lamp has ignited the frequency f is changed to a value corresponding to stationary operation of the lamp during which the lamp is operated directly by the inverter.

What is claimed is:

1. A circuit arrangement for operating a discharge lamp comprising:

circuit input terminals for connection to a supply voltage source, an inverter coupled to said circuit input terminals for generating an AC voltage with a frequency f from a supply voltage supplied by the supply voltage source, and including inverter output terminals, a piezotransformer comprising transformer input terminals, coupled to the inverter output terminals, and transformer output terminals, terminals for lamp connection coupled to the inverter output terminals and to the piezotransformer output terminals, a detector for detecting whether the lamp has ignited, characterized in that the inverter comprises frequency control means coupled to the detector for changing the frequency f in response to the ignition of the lamp.

2. The circuit arrangement according to claim 1, wherein the transformer input terminals are connected to the inverter output terminals only by means of passive components.

3. The circuit arrangement according to claim 1, wherein the frequency control means change the frequency from a first fixed value to a second fixed value in response to the ignition of the lamp.

4. The circuit arrangement according to claim 1, wherein a first transformer output terminal is coupled to one of the terminals for lamp connection and a second transformer output terminal is coupled to an auxiliary electrode.

5. The circuit arrangement according to claim 1, wherein the detector comprises a current sensor.

6. The circuit arrangement according to claim 1, wherein the inverter comprises a bridge circuit.

7. The circuit arrangement according to claim 1, wherein the piezotransformer has first and second input terminals connected directly to respective inverter output terminals.

8. The circuit arrangement according to claim 2 wherein, in response to a signal from the detector indicating ignition of the discharge lamp, the frequency control means change the frequency from a first fixed value to a second fixed value determined by the resonant frequencies of the piezoelectric transformer.

9. The circuit arrangement according to claim 1 wherein said lamp connection terminals comprise first and second lamp connection terminals adapted for connection to first and second main electrodes, respectively, of a discharge lamp and which define an arc discharge path within the lamp, first means coupling a first output terminal of the piezoelectric transformer to the first lamp connection terminal and to a first inverter output terminal, second means coupling a second output terminal of the piezoelectric transformer to an auxiliary electrode for lamp ignition, and third means coupling an input terminal of the piezoelectric transformer to a second inverter output terminal and to the second lamp connection terminal.

10. The circuit arrangement according to claim 1 further comprising;

an inductor coupled between an output terminal of the inverter and an output terminal of the piezoelectric transformer, said output terminal of the piezoelectric transformer being connected to a first one of said lamp connection terminals, and a capacitor coupled between said output terminal of the inverter and ground.

11. The circuit arrangement according to claim 10 wherein a further terminal of the piezoelectric transformer is connected to a second one of the lamp connection terminals and to a further output terminal of the inverter.

12. The circuit arrangement according to claim 1 wherein a piezoelectric transformer output terminal is coupled to an inverter output terminal only via passive non-resonant reactive components.

13. The circuit arrangement according to claim 1 wherein the piezoelectric transformer output terminals are coupled to the lamp connection terminals and at least one of said piezoelectric transformer output terminals is connected to one inverter output terminal.

14. The circuit arrangement according to claim 1 wherein, in response to detection of lamp ignition by the detector, the frequency control means changes the inverter frequency f to another frequency that differs substantially from all resonant frequencies of the piezotransformer.

15. The circuit arrangement according to claim 1 wherein the piezotransformer input terminals are coupled in parallel with the lamp connection terminals to the inverter output terminals.

16. The circuit arrangement according to claim 1 wherein the lamp connection terminals are coupled to the inverter output terminals via a circuit path that is independent of the piezotransformer.

17. The circuit arrangement according to claim 1 wherein one piezotransformer input terminal is connected to one lamp connection terminal via an inductor.

18. The circuit arrangement according to claim 3 wherein the first fixed frequency value is determined by a resonant frequency of the piezotransformer and the second fixed frequency value differs substantially from all resonant frequencies of the piezotransformer.

19. The circuit arrangement according to claim 1 wherein the inverter frequency f corresponds to a resonant frequency of the piezotransformer, and means for coupling the detector and the lamp connection terminals in a series circuit to the inverter output terminals, said series circuit being independent of the piezotransformer.

20. The circuit arrangement according to claim 1 wherein the inverter provides a squarewave AC voltage at the frequency f at its output terminals and the inverter frequency f corresponds to a resonant frequency of the piezotransformer, and the frequency of the inverter is changed to another frequency that differs substantially from all resonant frequencies of the piezotransformer.

* * * * *